US010125411B2

(12) United States Patent
Takahashi et al.

(10) Patent No.: US 10,125,411 B2
(45) Date of Patent: Nov. 13, 2018

(54) β-TYPE TITANIUM ALLOY

(71) Applicant: NIPPON STEEL & SUMITOMO METAL CORPORATION, Tokyo (JP)

(72) Inventors: Kazuhiro Takahashi, Tokyo (JP); Hideki Fujii, Tokyo (JP); Kenichi Mori, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 15/695,143

(22) Filed: Sep. 5, 2017

(65) Prior Publication Data

US 2017/0362686 A1 Dec. 21, 2017

Related U.S. Application Data

(62) Division of application No. 13/358,483, filed on Jan. 25, 2012, now Pat. No. 9,822,431, which is a division (Continued)

(30) Foreign Application Priority Data

Oct. 26, 2006 (JP) ..... 2006-291135
Sep. 26, 2007 (JP) ..... 2007-249351

(51) Int. Cl.
*C22C 14/00* (2006.01)
*C22F 1/00* (2006.01)
*C22F 1/18* (2006.01)

(52) U.S. Cl.
CPC ..... *C22C 14/00* (2013.01); *C22F 1/00* (2013.01); *C22F 1/18* (2013.01)

(58) Field of Classification Search
None
See application file for complete search history.

(56) References Cited

U.S. PATENT DOCUMENTS 3,156,590 A 11/1964 Vordahl
5,294,267 A * 3/1994 Bania ..... C22C 14/00 148/407
2008/0092997 A1 4/2008 Matsumoto

FOREIGN PATENT DOCUMENTS

GB 785293 A 10/1957
JP 3-61341 A 3/1991

(Continued)

OTHER PUBLICATIONS

Extended Search Report, dated Mar. 10, 2010, for corresponding European Patent Application No. 07830892.1-2122 / 2078760 PCT/JP2007071158.

(Continued)

*Primary Examiner* — Yoshitoshi Takeuchi
(74) *Attorney, Agent, or Firm* — Birch, Stewart, Kolasch & Birch, LLP

(57) ABSTRACT

The present invention provides a β-type titanium alloy that includes, by mass %, when Al: 2 to 5%, 1) Fe: 2 to 4%, Cr: 6.2 to 11%, and V: 4 to 10%, 2) Fe: 2 to 4%, Cr: 5 to 11%, and Mo: 4 to 10%, or 3) Fe: 2 to 4%, Cr: 5.5 to 11%, and Mo+V (total of Mo and V): 4 to 10% in range, and a balance of substantially Ti. These include Zr added in amounts of 1 to 4 mass %. Furthermore, by making the oxygen equivalent Q 0.15 to 0.30 or leaving the alloy in the work hardened state or by applying both, the tensile strength before aging heat treatment can be further increased.

4 Claims, 1 Drawing Sheet

Related U.S. Application Data of application No. 12/447,402, filed as application No. PCT/JP2007/071158 on Oct. 24, 2007, now Pat. No. 9,816,158.

(56) References Cited

FOREIGN PATENT DOCUMENTS

| | | | |
|---|---|---|---|
| JP | 3-79736 | A | 4/1991 |
| JP | 3-134126 | A | 6/1991 |
| JP | 7-292429 | A | 11/1995 |
| JP | 2859102 | B2 | 2/1999 |
| JP | 2002-235133 | A | 8/2002 |
| JP | 2004-270009 | A | 9/2004 |
| JP | 2005-60821 | A | 3/2005 |
| JP | 2005-154850 | A | 6/2005 |
| JP | 2006-34414 | A | 2/2006 |
| JP | 2006-111934 | A | 4/2006 |
| JP | 2006-111935 | A | 4/2006 |
| WO | WO 2006/041166 | A1 | 4/2006 |

OTHER PUBLICATIONS

Novikov et al., "Physical Metallurgy, Thermal Treatment, and Rentgenography," MISIS, Moscow, 1994, p. 339.
Russian Office Action, dated Jun. 18, 2010, for corresponding Russian Application No. 2009119712/02(027173).
U.S. Office Action. dated Jul. 18, 2011, for U.S. Appl. No. 12/447/402.
U.S. Office Action, dated Oct. 25, 2011, for U.S. Appl. No. 12/447,402.
Advisory Action dated Apr. 8, 2015, for U.S. Appl. No. 12/447,402.
Advisory Action dated Aug. 4, 2016, for U.S. Appl. No. 12/447,402.
Advisory Action dated Aug. 5, 2016, for U.S. Appl. No. 13/358,483.
Advisory Action dated Mar. 20, 2015, for U.S. Appl. No. 13/358,483.
Advisory Action dated May 8, 2014, for U.S. Appl. No. 12/447,402.
International Search Report issued in PCT/JP2007/071158 dated Jan. 8, 2008.
Supplemental Notice of Allowance dated Aug. 15, 2017, for U.S. Appl. No. 12/447,402.
U.S. Final Office Action, dated Apr. 21, 2016, for U.S. Appl. No. 13/358,483.
U.S. Final Office Action, dated Apr. 29, 2016, for U.S. Appl. No. 12/447,402.
U.S. Final Office Action, dated Dec. 11, 2014, for U.S. Appl. No. 13/358,483.
U.S. Final Office Action, dated Dec. 12, 2014, for U.S. Appl. No. 12/447,402.
U.S. Final Office Action, dated May 21, 2013, for U.S. Appl. No. 13/358,483.
U.S. Final Office Action, dated Nov. 29, 2013, for U.S. Appl. No. 12/447,402.
U.S. Non-Final Office Action, dated Jan. 6, 2016, for U.S. Appl. No. 13/358,483.
U.S. Non-Final Office Action, dated Jan. 7, 2016, for U.S. Appl. No. 12/447,402.
U.S. Non-Final Office Action, dated Jul. 30, 2014, for U.S. Appl. No. 12/447,402.
U.S. Non-Final Office Action, dated Jul. 30, 2014, for U.S. Appl. No. 13/358,483.
U.S. Non-Final Office Action, dated Mar. 21, 2017, for U.S. Appl. No. 12/447,402.
U.S. Non-Final Office Action, dated Mar. 21. 2017, for U.S. Appl. No. 13/358,483.
U.S. Non-Final Office Action, dated May 22, 2013, for U.S. Appl. No. 12/447,402.
U.S. Non-Final Office Action, dated Nov. 30, 2012, for U.S. Appl. No. 13/358,483.
U.S. Notice of Allowability, dated Aug. 4, 2017, for U.S. Appl. No. 12/447,402.
U.S. Notice of Allowance, dated Aug. 3, 2017, for U.S. Appl. No. 13/358,483.

* cited by examiner

β-TYPE TITANIUM ALLOY

This application is a Divisional of pending U.S. application Ser. No. 13/358,483 filed on Jan. 25, 2012, which is a Divisional of U.S. application Ser. No. 12/447,402 filed on Apr. 27, 2009, which is a U.S. National Phase application of PCT International Application No. PCT/JP2007/071158 filed on Oct. 24, 2007, which claims the benefit of priority of Japanese Patent Application No. 2007-249351 filed in Japan on Sep. 26, 2007, and Japanese Patent Application No. 2006-291135 filed in Japan on Oct. 26, 2006. The entire contents of all of the above applications are hereby incorporated by reference.

TECHNICAL FIELD

The present invention relates to a β-type titanium alloy.

BACKGROUND ART

β-type titanium alloys are titanium alloys to which V, Mo, or other β-type stabilizing elements are added to retain a stable β-phase at room temperature. β-type titanium alloys are superior in cold workability. Due to precipitation hardening of a fine α phase during aging heat treatment, a tensile strength of a high strength of approximately 1400 MPa is obtained and the Young's modulus is relatively low, so the alloys are used for springs, golf club heads, fasteners, and various other applications.

Conventional β-type titanium alloys contain large amounts of V or Mo such as a Ti-15 mass % V-3 mass % Cr-3 mass % Sn-3 mass % Al (hereinafter, "mass %" omitted), Ti-13V-11Cr-3Al, and Ti-3Al-8V-6Cr-4Mo-4Zr. The total amount of V and Mo is 12 mass % or more.

As opposed to this, β-type titanium alloys in which the amounts of addition of V and Mo are suppressed and the relatively inexpensive β-type stabilizing elements of Fe and Cr are added have been proposed.

The invention described in Japanese Patent No. 2859102 is a Ti—Al—Fe—Mo-based β-type titanium alloy which has an Mo eq (Mo equivalent) larger than 16. A typical composition is Al: 1 to 2 mass %, Fe: 4 to 5 mass %, Mo: 4 to 7 mass %, and O (oxygen): 0.25 mass % or less.

The inventions described in Japanese Patent Publication (A) No. 03-61341, Japanese Patent Publication (A) No. 2002-235133, and Japanese Patent Publication (A) No. 2005-60821 are Ti—Al—Fe—Cr-based β-type titanium alloys in which V and Mo are not added and in which, by mass %, Fe is in a range of 1 to 4%, 8.8% or less (however, Fe+0.6Cr is 6 to 10%), and 5% or less, respectively and Cr is in a range of 6 to 13%, 2 to 12% (however, Fe+0.6Cr is 6 to 10%), and 10 to 20%, respectively.

The inventions described in Japanese Patent Publication (A) No. 2005-154850, Japanese Patent Publication (A) No. 2004-270009, and Japanese Patent Publication (A) No. 2006-111934 are respectively Ti—Al—Fe—Cr—V—Mo—Zr-based, Ti—Al—Fe—Cr—V—Sn-based, and Ti—Al—Fe—Cr—V—Mo-based β-type titanium alloys. In each, Fe and Cr are both added and both or either of V and Mo are included. Furthermore, in Japanese Patent Publication (A) No. 2005-154850 and Japanese Patent Publication (A) No. 2004-270009, respectively, 2 to 6 mass % of Zr and 2 to 5 mass % of Sn are added.

DISCLOSURE OF THE INVENTION

As explained above, Japanese Patent No. 2859102, Japanese Patent Publication (A) No. 03-61341, Japanese Patent Publication (A) No. 2002-235133, Japanese Patent Publication (A) No. 2005-60821, Japanese Patent Publication (A) No. 2005-154850, Japanese Patent Publication (A) No. 2004-270009, and Japanese Patent Publication (A) No. 2006-111934 are β-type titanium alloys in which the amounts of addition of V and Mo are suppressed and the relatively inexpensive β-type stabilizing elements Fe and Cr are added.

However, the inexpensive β-stabilizing element Fe easily segregates at the time of solidification in the melting process. In Japanese Patent No. 2859102 (Ti—Al—Fe—Mo-based), Fe is contained in as much as 4 to 5 mass %. If added in a large amount over 4 mass %, composition segregation results in a higher possibility of variations occurring in the material properties or aging hardening property. Further, Japanese Patent No. 2859102 does not contain Cr.

In Japanese Patent Publication (A) No. 03-61341, Japanese Patent Publication (A) No. 2002-235133, and Japanese Patent Publication (A) No. 2005-60821, in addition to Fe, the relatively inexpensive β-stabilizing element Cr is used in large amounts. V and Mo are not used. However, Cr segregates in the same way as Fe, so even in β-type titanium alloys having β-stabilizing elements comprised of Fe and Cr alone and having these added in large amounts, the composition segregation causes variations in the material properties and aging hardening property. Areas of high strength and areas of low strength are formed. When the difference of strength between these areas is large, if using the material for coil-shaped springs and other springs, there is a higher possibility of the low strength areas forming starting points of fatigue fracture and the lifetime becoming shorter.

Japanese Patent Publication (A) No. 2005-154850, Japanese Patent Publication (A) No. 2004-270009, and Japanese Patent Publication (A) No. 2006-111934 are based on Ti—Al—Fe—Cr—V—Mo and have V and Mo added as well. Japanese Patent Publication (A) No. 2005-154850 and Japanese Patent Publication (A) No. 2006-111934 have relatively small amounts of Cr of 4 mass % or less and 0.5 to 5 mass %. The effects of composition segregation are considered smaller compared with the above-mentioned Japanese Patent No. 2859102, Japanese Patent Publication (A) No. 03-61341, Japanese Patent Publication (A) No. 2002-235133, and Japanese Patent Publication (A) No. 2005-60821. However, the amount of Cr is small, so the contribution to the base solid-solution strengthening is not sufficient. To increase the strength, precipitation strengthening of the α phase by aging heat treatment ends up being relied on greatly. Note that, as described in the examples of Japanese Patent Publication (A) No. 2006-111934, the tensile strength before aging heat treatment is 886 MPa or less. For this reason, if causing the precipitation of the α phase by aging heat treatment to raise the strength, the Young's modulus ends up becoming higher and the characteristic of β-type titanium alloys, the low Young's modulus, can no longer be sufficiently utilized. This is because, compared with the β-phase, the α phase has a 20 to 30% or so larger Young's modulus. To obtain high strength while maintaining a relatively low Young's modulus, it is necessary to raise the base strength before aging heat treatment and keep the amount of precipitation of the α phase due to the aging heat treatment small. That is, as the strengthening mechanism, it is effective to keep the contribution of the α phase to precipitation strengthening small and make greater use of solid-solution strengthening and work strengthening (work hardening). Further, if adding an amount of Cr of a fixed amount or more, the effects of segregation can be reduced, but in both Japanese Patent Publication (A) No. 2005-

154850 and Japanese Patent Publication (A) No. 2006-111934, the amount of Cr is small and the effect is not sufficient.

In this regard, if the amount of Cr of Japanese Patent Publication (A) No. 2004-270009 is 6 to 10 mass %, it is greater than Japanese Patent Publication (A) No. 2005-154850 and Japanese Patent Publication (A) No. 2006-111934. That amount contributes more to the solid-solution strengthening. However, in Japanese Patent Publication (A) No. 2004-270009, the neutral element (neither a stabilizing or β stabilizing element) Sn is contained in an amount of 2 to 5 mass %. This Sn, as will be understood from the Periodic Table, has an atomic weight of 118.69 or over 2.1 times the Ti, Fe, Cr, and V and raises the density of the titanium alloy. In applications where titanium alloys are used for the purpose of reducing the weight (increasing the specific strength) (springs, golf club heads, fasteners, etc.), avoiding the addition of Sn is advantageous.

From the above, the present invention has as its object the provision of a β-type titanium alloy keeping the contents of the relatively expensive β-stabilizing elements such as V and Mo a total of a low 10 mass % or less, depressing the effects of composition segregation of Fe and Cr, and able to keep the Young's modulus and density relatively low. Furthermore, it has as its object applying the β-type titanium alloy of the present invention as a material for automobile and motorcycle coil-shaped springs and other springs, golf club heads, and bolts and nuts and other fasteners so as to provide products having stable material properties, low Young's modulus, and high specific strength at relatively inexpensive material costs.

The gist of the present invention to solve the above problems is as follows:

(1) A β-type titanium alloy containing, by mass %, Al: 2 to 5%, Fe: 2 to 4%, Cr: 6.2 to 11%, and V: 4 to 10% in ranges and having a balance of Ti and unavoidable impurities.

(2) A β-type titanium alloy containing, by mass %, Al: 2 to 5%, Fe: 2 to 4%, Cr: 5 to 11%, and Mo: 4 to 10% in ranges and having a balance of Ti and unavoidable impurities.

(3) A β-type titanium alloy containing, by mass %, Al: 2 to 5%, Fe: 2 to 4%, Cr: 5.5 to 11%, and Mo+V (total of Mo and V): 4 to 10% by Mo: 0.5% or more and V: 0.5% or more in ranges and having a balance of Ti and unavoidable impurities.

(4) A β-type titanium alloy as set forth in any one of the above (1) to (3), said β-type titanium alloy characterized by further containing, by mass %, Zr: 1 to 4% in range.

(5) A β-type titanium alloy as set forth in any one of the above (1) to (4), characterized in that an oxygen equivalent Q of formula [1] is 0.15 to 0.30:

$$\text{Oxygen equivalent } Q=[O]+2.77[N] \qquad \text{formula [1]}$$

where, [O] is O (oxygen) content (mass %) and [N] is N content (mass %).

(6) A worked product obtained by work hardening a β-type titanium alloy as set forth in any one of the above (1) to (5).

Here, the "worked product as work hardened" of (6) of the present invention means sheets/plates, bars/wires, and other shaped products in the state as worked by rolling, drawing, forging, press forming, etc. and is harder, that is, higher in strength, compared with the state as annealed.

BEST MODE FOR CARRYING OUT THE INVENTION

The inventors discovered that by including as β-stabilizing elements both the relatively inexpensive Fe and Cr in larger amounts and including one or both of V and Mo (in total) in predetermined amounts to 10 mass %, it is possible to suppress the effects of composition segregation and achieve stabilized properties and to raise tensile strength before aging heat treatment and thereby completed the present invention. Furthermore, they discovered that by making the oxygen equivalent Q(=[O]+2.77[N]) of formula [1] 0.15 to 0.30 or leaving the alloy in the work hardened state and further by performing both, it is possible to further raise the tensile strength before aging heat treatment. In this way, by raising the tensile strength before aging heat treatment, it is possible to achieve a high tensile strength by aging heat treatment while maintaining a relatively low Young's modulus.

Below, we will explain the grounds for setting the component elements of the present invention.

Al is an α-stabilizing element. It promotes precipitation of the α phase at the time of aging heat treatment, so contributes to precipitation strengthening. If Al is less than 2 mass %, the contribution of the α phase to the precipitation strengthening is excessively small, while if over 5 mass %, superior cold workability can no longer be obtained. Therefore, in the present invention, Al is made 2 to 5 mass % in range. When making much of the cold workability, 2 to 4 mass % of Al is preferable.

Next, the β-stabilizing elements will be explained. With Fe alone, the effect of composition segregation is great. In industrial production involving large-scale melting, there is a limit to the amounts which can be added, so in the present invention, both Fe and Cr are added as relatively inexpensive β-stabilizing elements.

As means for eliminating the effects of the problem of composition segregation of Fe and Cr, there is the method of adding a certain amount of Cr or more and thereby reducing the ratio of the difference in concentration by the location of the Cr with respect to the average concentration of Cr (=concentration difference/average concentration) and consequently reducing the effects of segregation. Further, the following method of utilizing the relatively expensive β-stabilization elements of V and Mo may be considered. V has small segregation at the time of solidification and is substantially evenly distributed, while Mo is distributed in concentration by an inverse tendency from Fe and Cr. That is, at locations where the Mo concentration is high, the concentrations of Fe and Cr are low, while at locations where the Mo concentration is low, the reverse is true. It is possible to use the uniformly distributed V as the base to secure the stability of the β-phase and further to depress the effects of segregation of Fe and Cr by Mo.

Figure 1:
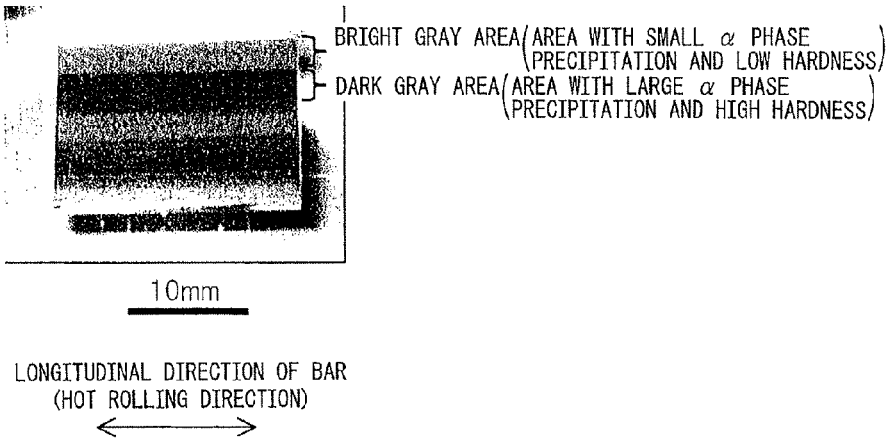
FIG. 1 is a view showing a macrostructure of an L-cross-section of an aging heat treated bar.
Figure 2:
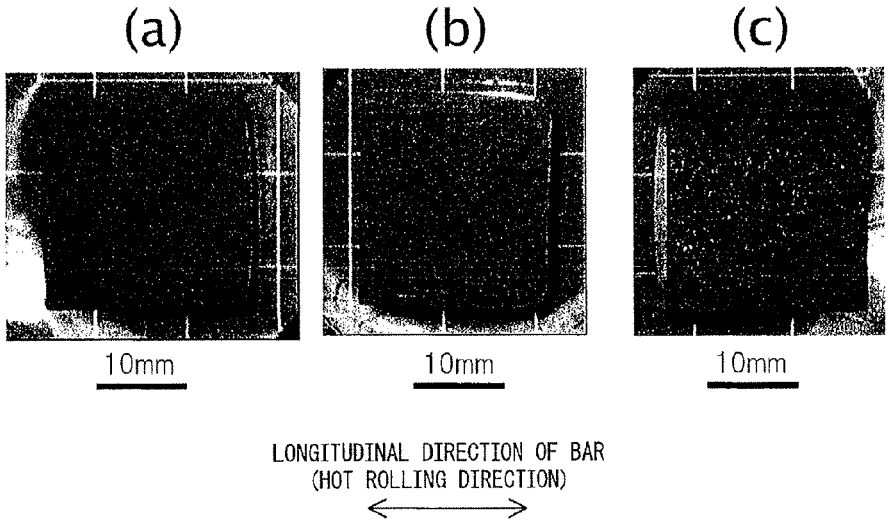
FIG. 2 is a view a macrostructure of an L-cross-section of an aging heat treated bar, wherein (a), (b), and (c) show examples of the present invention.

The degree of composition segregation can be judged by observing the macro structure obtained by etching the cross-section after aging heat treatment causing precipitation of the α phase. Due to the segregation of the β-stabilizing elements, the rate and amount of precipitation of the α phase differ, so a difference appears in the metal structure due to the segregated locations. FIG. 1 is an example of remarkable occurrence of segregation in the distribution of the fine precipitation of the α phase due to one-sided segregation of the β-phase stabilizing elements in a β-type titanium alloy, while FIG. 2 shows an example of suppressing segregation in the distribution of the fine precipitation of the α phase due to the design of the combination of the β-phase stabilizing elements in the β-type titanium alloy. FIG. 1 and FIG. 2 are examples of the cases of solution treating and annealing hot rolled bars of β-type titanium alloy in the single β phase region, then treating these by aging heat treatment at 500° C. for 24 hours. In both FIG. 1 and FIG. 2, the L cross-section of the bar (cross-section parallel to longitudinal direction of bar) is polished, then the bar is dipped in a titanium use etching solution (containing hydrofluoric acid and nitric acid) to make the structure easy to observe. In FIG. 1, the effects of composition segregation appear strikingly. The parts where the amount of precipitation of the α phase is small (bright gray bands sandwiched between dark gray areas) and the parts where the amount is large (dark gray areas) can be clearly visually distinguished. The dark gray areas contain large amounts of finely precipitated α phase, so are hard, while the bright gray areas are softer. In the example of FIG. 1, the Vicker's hardness of the dark gray color areas is about 440, while in the bright gray bands it is a value lower by about 105 points. This is a phenomena due to the segregation of the β-stabilizing elements as explained above. Only naturally, they have a large effect on the material quality. On the other hand, FIGS. 2(*a*), (*b*), and (*c*) are examples where the bright gray coarse areas such as FIG. 1 cannot be seen and the α phase is substantially uniformly precipitated. Note that, in the cross-sections of FIGS. 2(*a*), (*b*), and (*c*), if the Vicker's hardness is randomly measured at six points, the difference of the values (measured in the cross-sections of FIGS. 2(*a*), (*b*), and (*c*)) range from 10 to 20 between the maximum value and the minimum value, or are much smaller than the difference of values measured at six points in the cross-sections of example of FIG. 1. In the present invention, this method of judgment is used. From here, it will be called the "segregation judgment method". Note that the Vicker's hardness was measured at a load of 9.8N.

Further, to keep the Young's modulus after aging heat treatment low, as explained above, with aging heat treatment, it is necessary to raise the strength by a small precipitation of the α phase. For this reason, it is necessary to raise the base tensile strength before aging heat treatment. The tensile strength before aging heat treatment is, in Japanese Patent Publication (A) No. 2006-111934, an average of about 830 MPa and is at most 886 MPa, while in the present invention, a value 10% more than the lower limit of 830 MPa, that is, 920 MPa, can be achieved.

The contents of the β-stabilizing elements (Fe and Cr and V and Mo) resulting in small effects of composition segregation and in tensile strengths before aging heat treatment of 920 MPa or more differ depending on their combination but are, by mass %, when Al is 2 to 5%, "Fe: 2 to 4%, Cr: 6.2 to 11%, and V: 4 to 10% in range" ((1) of the present invention), "Fe: 2 to 4%, Cr: 5 to 11%, and Mo: 4 to 10% in range" ((2) of the present invention), or "Fe: 2 to 4%, Cr: 5.5 to 11%, and Mo+V (total of Mo and V): 4 to 10% in range" ((3) of the present invention). Therefore, (1), (2), and (3) of the present invention have ranges of chemical compositions in the above ranges. However, in (3) of the present invention, both Mo and V are contained, Mo is 0.5% or more, and V is 0.5% or more. When Fe, Cr, Mo, and V are less than the above ranges, sometimes a stable β-phase cannot be obtained. On the other hand, the relatively expensive V and Mo do not have to be excessively added over the upper limits. If Fe and Cr are over the upper limits, the effects of composition segregation sometimes become remarkable. In the present invention, preferably, by mass %, when Al is 2 to 4%, the ranges are "Fe: 2 to 4%, Cr: 6.5 to 9%, and V: 5 to 10%" ((1) of the present invention), "Fe: 2 to 4%, Cr: 6 to 10%, and Mo: 5 to 10%" ((2) of the present invention), "Fe: 2 to 4%, Cr: 6 to 10%, and Mo+V (total of Mo and V): 5 to 10%" ((3) of the present invention). In the preferable ranges, even when the aging heat treatment is a short time of less than 24 hours, the good states shown in FIG. 2 are exhibited by evaluation by the segregation evaluation method and the effects of composition segregation become smaller.

On the other hand, in the present invention, from the viewpoint of more efficient hardening (strengthening) by a shorter time of aging heat treatment, by mass %, when Al is 2 to 4%, the ranges of "Fe: 2 to 4%, Cr: 6.2 to 8%, and V: 4 to 6%" ((1) of the present invention), "Fe: 2 to 4%, Cr: 5 to 7%, and Mo: 4 to 6%" ((2) of the present invention), "Fe: 2 to 4%, Cr: 5.5 to 7.5%, and Mo+V (total of Mo and V): 4 to 6%" ((3) of the present invention) are preferable. These ranges correspond to the regions of small amounts of the β-stabilizing elements Cr, V, and Mo in (1) of the present invention, (2) of the present invention, (3) of the present invention.

Zr is a neutral element in the same way as Sn. By including 1 mass % or more, this contributes to higher strength. Even if including 4 mass % or less, the tendency to increase the density is smaller than with Sn. From the balance of the improvement of strength and the increase of density, (4) of the present invention is a β-type titanium alloy of any one of claims 1 to 3 further including Zr: 1 to 4 mass %.

In β-type titanium alloys of the above compositions, it is also possible to improve the strength before aging heat treatment by O and N. On the other hand, if the amounts of O and N are too high, sometimes superior cold workability can no longer be maintained. The contributions of O and N to strength can be evaluated by the oxygen equivalent Q (=[O]+2.77×[N]) of formula [1]. Regarding this Q, when the solid-solution strengthening ability of a β-type titanium alloy per 1 mass % concentration of oxygen, that is, the contribution to the increase in tensile strength, is "1", the contribution of nitrogen to the solid-solution strengthening ability is 2.77 times that of oxygen, so the nitrogen concentration is multiplied with 2.77 to convert it to the oxygen concentration. In (5) of the present invention, both an improvement of strength and superior cold working can be achieved, so in the β-type titanium alloy of any one of (1) to (4) of the present invention, the oxygen equivalent Q is made 0.15 to 0.30 in range.

Further, in addition to the chemical composition, even by work hardening, it is possible to raise the strength before the aging heat treatment, so (6) of the present invention provides a β-type titanium alloy of any one of (1) to (5) of the present invention characterized by being in a state as work hardened by rolling (cold rolling etc.), drawing (cold drawing etc.), press forming, forging, or other work. The shape may be plate/sheets, bars/wires, and various products shaped from them.

Note that, the titanium alloy of the present invention, in the same way as pure titanium or other titanium alloy, unavoidably contains H, C, Ni, Mn, Si, S, etc., but the contents are in general respectively less than 0.05 mass %. However, so long as the effect of the present invention is not impaired, the content is not limited to one less than 0.05 mass %. H is a β-stabilizing element and tends to delay the precipitation of the α phase at the time of aging heat treatment, so an H concentration of 0.02 mass % or less is preferable.

The β-type titanium alloy of the present invention explained above, from its composition, may include, in addition to metals such as Fe and Cr, relatively inexpensive materials such as ferromolybdenum, ferrovanadium, ferrochrome, ferrite-based stainless steel such as SUS430, lower grade sponge titanium, pure titanium and various titanium alloys in scraps etc.

EXAMPLES

Example 1

(1) to (3) of the present invention will be explained in further detail using the following examples.

Ingots obtained by vacuum melting were heated at 1100 to 1150° C. and hot forged to prepare intermediate materials which were then heated at 900° C. and hot forged to bars of a diameter of about 15 mm. After this, the bars were solution treated and annealed at 850° C. and air cooled.

The solution treated and annealed materials were machined into tensile test pieces with parallel parts of a diameter of 6.25 mm and lengths of 32 mm, subjected to tensile tests at room temperature, and measured for tensile strength before aging heat treatment. To evaluate the cold workability, the solution treated and annealed materials were descaled (shot blasted, then dipped in nitric-hydrofluoric acid solution), then lubricated and cold drawn by a die to a cross-sectional reduction of 50% in area. Surface fractures or breakage were checked for by the naked eye between the cold drawing passes. Test pieces with fractures or breakage before the cross-sectional reduction reaching 50% were evaluated as "poor" while ones without them were evaluated as "good". Further, the effects of composition segregation were evaluated by the above-mentioned segregation evaluation method. This method treats a solution treated and annealed material further at 500° C. for 24 hours for aging heat treatment, then polishes the L-cross-section, etches it by a titanium use etching solution, visually observes the metal structure, and. following the examples of FIG. 1 and FIG. 2, judges them as "poor" when the state is like FIG. 1 and "good" when it is like FIG. 2.

Table 1, Table 2, and Table 3 show the chemical compositions, the success of cold drawing, the tensile strength before aging heat treatment (solution treated and annealed material), the results of evaluation by the segregation judgment method, etc. Table 1, Table 2, and Table 3 relate to (1), (2), and (3) of the present invention. Note that the H concentration was 0.02 mass % or less in each case.

TABLE 1

| Sample | Chemical compositions (mass %) | | | | | | | | Oxygen equivalent Q | Cold drawing 50% | Pre-aging heat treatment solution treated and annealed material Tensile | Result of evaluation by segregation judgment method | |
|---|---|---|---|---|---|---|---|---|---|---|---|---|---|
| No. | Al | Fe | Cr | V | Mo | Zr | O | N | formula [1] | success | strength (MPa) | (others) | Remarks |
| 1 | 3.2 | 2.0 | 8.0 | 7.7 | — | — | 0.159 | 0.007 | 0.178 | Good | 985 | Good | Inv. ex. |
| 2 | 3.1 | 2.0 | 8.9 | 5.8 | — | — | 0.162 | 0.007 | 0.181 | Good | 974 | Good | Inv. ex. |
| 3 | 3.1 | 3.0 | 8.0 | 4.3 | — | — | 0.167 | 0.007 | 0.186 | Good | 975 | Good | Inv. ex. |
| 4 | 4.0 | 3.0 | 8.9 | 8.5 | — | — | 0.166 | 0.008 | 0.188 | Good | 1012 | Good | Inv. ex. |
| 5 | 4.5 | 3.8 | 10.7 | 8.5 | — | — | 0.158 | 0.007 | 0.177 | Good | 1053 | Good | Inv. ex. |
| 6 | 3.1 | 2.8 | 6.2 | 4.4 | — | — | 0.161 | 0.006 | 0.178 | Good | 948 | Good | Inv. ex. |
| 7 | 2.1 | 2.6 | 6.9 | 7.4 | — | — | 0.148 | 0.006 | 0.165 | Good | 954 | Good | Inv. ex. |
| 8 | 3.0 | 2.5 | 7.9 | 9.4 | — | — | 0.149 | 0.007 | 0.168 | Good | 966 | Good | Inv. ex. |
| 9 | 3.0 | 2.9 | 9.9 | — | — | — | 0.157 | 0.008 | 0.179 | Good | 924 | Poor | Comp. ex. |
| 10 | 1.1 | 2.0 | 8.1 | 7.8 | — | — | 0.164 | 0.007 | 0.183 | Good | 928 | (Bright gray, small hardening) | Comp. ex. |
| 11 | 5.6 | 2.6 | 8.1 | 7.4 | — | — | 0.158 | 0.007 | 0.177 | Poor | 1104 | (with α phase as solution treated) | Comp. ex. |
| 12 | 3.1 | 4.9 | 6.5 | 7.8 | — | — | 0.150 | 0.006 | 0.167 | Good | 970 | Poor | Comp. ex. |
| 13 | 3.1 | 2.4 | 3.9 | 7.5 | — | — | 0.156 | 0.006 | 0.173 | Good | 895 | Good | Comp. ex. |
| 14 | 3.1 | 2.6 | 8.7 | 3.4 | — | — | 0.156 | 0.006 | 0.173 | Good | 938 | Poor | Comp. ex. |
| 15 | 3.0 | 2.6 | 12.4 | 7.5 | — | — | 0.154 | 0.008 | 0.176 | Good | 1079 | Poor | Comp. ex. |

TABLE 2

| Sample | Chemical compositions (mass %) | | | | | | | | Oxygen equivalent Q | Cold drawing 50% | Pre-aging heat treatment solution treated and annealed material Tensile | Result of evaluation by segregation judgment method | |
|---|---|---|---|---|---|---|---|---|---|---|---|---|---|
| No. | Al | Fe | Cr | V | Mo | Zr | O | N | formula [1] | success | strength (MPa) | (others) | Remarks |
| 16 | 3.1 | 2.0 | 7.4 | — | 7.2 | — | 0.164 | 0.008 | 0.186 | Good | 979 | Good | Inv. ex. |
| 17 | 3.0 | 2.0 | 8.9 | — | 5.8 | — | 0.167 | 0.008 | 0.189 | Good | 979 | Good | Inv. ex. |
| 18 | 2.9 | 3.0 | 8.9 | — | 4.8 | — | 0.172 | 0.007 | 0.191 | Good | 968 | Good | Inv. ex. |
| 19 | 3.1 | 2.2 | 10.4 | — | 4.3 | — | 0.141 | 0.006 | 0.158 | Good | 982 | Good | Inv. ex. |
| 20 | 3.0 | 2.3 | 5.1 | — | 9.4 | — | 0.135 | 0.006 | 0.152 | Good | 950 | Good | Inv. ex. |
| 21 | 3.2 | 3.9 | 7.4 | — | 6.1 | — | 0.148 | 0.008 | 0.170 | Good | 959 | Good | Inv. ex. |
| 22 | 2.2 | 2.5 | 7.9 | — | 6.1 | — | 0.157 | 0.006 | 0.174 | Good | 950 | Good | Inv. ex. |

TABLE 2-continued

| Sample | Chemical compositions (mass %) | | | | | | | | Oxygen equivalent Q | Cold drawing 50% | Pre-aging heat treatment solution treated and annealed material Tensile | Result of evaluation by segregation judgment method | |
|---|---|---|---|---|---|---|---|---|---|---|---|---|---|
| No. | Al | Fe | Cr | V | Mo | Zr | O | N | formula [1] | success | strength (MPa) | (others) | Remarks |
| 23 | 4.0 | 2.4 | 6.3 | — | 8.6 | — | 0.165 | 0.005 | 0.179 | Good | 1008 | Good | Inv. ex. |
| 24 | 1.0 | 2.5 | 8.9 | — | 6.1 | — | 0.162 | 0.006 | 0.179 | Good | 938 | (Bright gray, small hardening) | Comp. ex. |
| 25 | 1.1 | 4.8 | 8.1 | — | 6.2 | — | 0.163 | 0.006 | 0.180 | Good | 938 | Poor | Comp. ex. |
| 26 | 3.0 | 2.3 | 4.0 | — | 7.5 | — | 0.170 | 0.007 | 0.189 | Good | 902 | Good | Comp. ex. |
| 27 | 3.1 | 2.3 | 8.9 | — | 3.2 | — | 0.157 | 0.007 | 0.176 | Good | 932 | Poor | Comp. ex. |
| 28 | 3.1 | 2.5 | 12.2 | — | 7.0 | — | 0.158 | 0.007 | 0.177 | Good | 995 | Poor | Comp. ex. |

TABLE 3

| Sample | Chemical compositions (mass %) | | | | | | | | Mo + V | Oxygen equivalent Q | Cold drawing 50% | Pre-aging heat treatment solution treated and annealed material Tensile | Result of evaluation by segregation judgment method | |
|---|---|---|---|---|---|---|---|---|---|---|---|---|---|---|
| No. | Al | Fe | Cr | V | Mo | Zr | O | N | (mass %) | formula [1] | success | strength (MPa) | (others) | Remarks |
| 29 | 3.1 | 2.0 | 8.9 | 2.0 | 3.9 | — | 0.171 | 0.008 | 5.9 | 0.193 | Good | 961 | Good | Inv. ex. |
| 30 | 3.0 | 2.0 | 8.9 | 3.0 | 4.0 | — | 0.168 | 0.010 | 7.0 | 0.196 | Good | 969 | Good | Inv. ex. |
| 31 | 2.9 | 2.0 | 9.0 | 2.0 | 2.0 | — | 0.166 | 0.007 | 4.0 | 0.185 | Good | 955 | Good | Inv. ex. |
| 32 | 3.0 | 2.5 | 5.5 | 2.2 | 3.5 | — | 0.165 | 0.006 | 5.7 | 0.182 | Good | 942 | Good | Inv. ex. |
| 33 | 3.0 | 3.6 | 6.8 | 0.5 | 3.7 | — | 0.162 | 0.007 | 4.2 | 0.181 | Good | 950 | Good | Inv. ex. |
| 34 | 3.1 | 3.1 | 6.9 | 4.9 | 0.6 | — | 0.170 | 0.008 | 5.5 | 0.192 | Good | 953 | Good | Inv. ex. |
| 35 | 2.9 | 2.4 | 10.5 | 3.1 | 4.0 | — | 0.160 | 0.007 | 7.1 | 0.179 | Good | 987 | Good | Inv. ex. |
| 36 | 2.8 | 2.4 | 7.5 | 4.2 | 4.9 | — | 0.158 | 0.005 | 9.1 | 0.172 | Good | 979 | Good | Inv. ex. |
| 37 | 3.0 | 2.2 | 8.9 | 1.2 | 2.2 | — | 0.171 | 0.006 | 3.4 | 0.188 | Good | 936 | Poor | Comp. ex. |
| 38 | 1.1 | 2.0 | 11.9 | 4.2 | 4.9 | — | 0.168 | 0.007 | 9.1 | 0.187 | Good | 992 | Poor | Comp. ex. |
| 39 | 3.0 | 3.5 | 2.0 | 6.5 | 2.8 | — | 0.157 | 0.007 | 9.3 | 0.176 | Good | 888 | Good | Comp. ex. |

Nos. 1 to 8 of Table 1 with chemical compositions in the range of (1) of the present invention (Al, Fe, Cr, and V) were free of fractures and other defects even with cold drawing to a cross-sectional reduction of 50%. The tensile strengths of the solution treated and annealed materials were over 920 MPa. The results of the segregation judgment method were also uniform macrostructures judged as "good". In Nos. 16 to 23 of in Table 2 and Nos. 29 to 36 of Table 3 as well, the chemical compositions were respectively in the ranges of (2) of the present invention (Al, Fe, Cr, and Mo) and (3) of the present invention (Al, Fe, Cr, Mo, and V), and in the same way as Nos. 1 to 8 of Table 1, there were no fractures or other defects even with cold drawing to a cross-sectional reduction of 50%, and the tensile strengths of the solution treated and annealed materials were over 920 MPa, and the results of the segregation judgment method were also uniform macrostructures judged as "good". While explained later, compared to the comparative examples where the Cr concentrations were lower than the lower limit, the tensile strengths of the solution treated and annealed materials were high 920 MPa or more. The required strengths could be achieved even with small extents of precipitation strengthening by the α phase.

As opposed to this, No. 10 and No. 24 with amounts of Al below the lower limit had bright gray macrostructures and small increases in the cross-section hardness even with treatment at 500° C. for 24 hours for aging heat treatment. Compared with the conventional β-type titanium alloys, precipitation of the α phase was slower. No. 11 with an amount of Al over the upper limit fractured in the middle of cold drawing and could not be said to have had superior cold workability.

No. 12 and No. 25 with Fe concentrations over the upper limit, Nos. 15, 28, and 38 with Cr concentrations over the upper limit, and Nos. 9, 14, 27, and 37 with amounts of V or Mo under the lower limits exhibited remarkable effects of composition segregation and were evaluated as "poor" by the segregation judgment method.

Nos. 13, 26, and 39 with Cr concentrations below the lower limit failed to achieve the targeted 920 MPa of tensile strength of the solution treated and annealed material.

Note that, in the examples of the present invention in Tables 1 to 3, the oxygen equivalent Q was about 0.15 to 0.2, but as explained later, even when Q was a small one of about 0.1, the tensile strength of the solution treated and annealed material was 920 MPa or more.

Example 2

(4) of the present invention will be explained in further detail using the following examples.

Table 4 shows examples of (4) of the present invention with Zr added. Note that the methods of production, methods of evaluation, etc. were the same as in the above-mentioned [Example 1]. All of the samples of Table 4 had H concentrations of 0.02 mass % or less.

TABLE 4

| Sample No. | Chemical compositions (mass %) Al | Fe | Cr | V | Mo | Zr | O | N | Mo + V (mass %) | Oxygen equivalent Q formula [1] | Cold drawing 50% success | Pre-aging heat treatment solution treated and annealed material Tensile strength (MPa) | Result of evaluation by segregation judgment method (others) | Remarks |
|---|---|---|---|---|---|---|---|---|---|---|---|---|---|---|
| 2-1 | 3.1 | 2.5 | 8.2 | 7.5 | — | 2.0 | 0.160 | 0.008 | — | 0.182 | Good | 998 | Good | Inv. ex. |
| 2-2 | 3.0 | 2.9 | 7.5 | 6.3 | — | 3.6 | 0.172 | 0.007 | — | 0.191 | Good | 1005 | Good | Inv. ex. |
| 2-3 | 3.0 | 2.2 | 7.5 | — | 6.5 | 1.4 | 0.168 | 0.007 | — | 0.187 | Good | 992 | Good | Inv. ex. |
| 2-4 | 3.0 | 2.3 | 5.9 | — | 7.2 | 2.5 | 0.166 | 0.007 | — | 0.185 | Good | 1002 | Good | Inv. ex. |
| 2-5 | 3.0 | 3.2 | 6.3 | 2.3 | 3.6 | 3.2 | 0.165 | 0.006 | 5.9 | 0.182 | Good | 989 | Good | Inv. ex. |
| 2-6 | 3.0 | 2.3 | 6.8 | 6.4 | 2.8 | 3.5 | 0.175 | 0.007 | 9.2 | 0.194 | Good | 1016 | Good | Inv. ex. |
| 2-7 | 3.1 | 2.0 | 9.0 | 2.0 | 3.8 | 2.0 | 0.171 | 0.008 | 5.8 | 0.193 | Good | 999 | Good | Inv. ex. |
| 2-8 | 3.0 | 5.3 | 7.3 | 8.1 | — | 2.1 | 0.162 | 0.008 | — | 0.184 | Good | 1006 | Poor | Comp. ex. |
| 2-9 | 3.1 | 2.5 | 11.9 | 7.3 | — | 2.1 | 0.171 | 0.008 | — | 0.193 | Good | 1020 | Poor | Comp. ex. |
| 2-10 | 3.1 | 2.4 | 9.0 | 3.4 | — | 2.0 | 0.168 | 0.007 | — | 0.187 | Good | 965 | Poor | Comp. ex. |
| 2-11 | 3.1 | 2.9 | 8.1 | — | 3.4 | 1.9 | 0.170 | 0.007 | — | 0.189 | Good | 971 | Poor | Comp. ex. |
| 2-12 | 3.0 | 2.3 | 8.9 | 1.8 | 1.8 | 2.0 | 0.171 | 0.008 | 3.6 | 0.193 | Good | 962 | Poor | Comp. ex. |
| 2-13 | 3.0 | 2.4 | 3.4 | 7.6 | — | 2.1 | 0.171 | 0.006 | — | 0.188 | Good | 908 | Good | Comp. ex. |
| 2-14 | 3.1 | 2.3 | 3.4 | — | 7.0 | 2.1 | 0.159 | 0.008 | — | 0.181 | Good | 909 | Good | Comp. ex. |
| 2-15 | 3.0 | 2.2 | 2.8 | 6.5 | 2.4 | 1.9 | 0.158 | 0.007 | 8.9 | 0.177 | Good | 902 | Good | Comp. ex. |

From Table 4, it is learned that Nos. 2-1 to 2-7 with Zr in the range of (4) of the present invention had a tensile strength of the solution treated and annealed materials of a high 980 MPa or more compared with the invention examples not containing Zr in Table 1, Table 2, and Table 3. Nos. 2-1 to 2-7 were free from fractures and other defects even with cold drawing of cross-sectional reduction of 50%, had results by the segregation judgment method of uniform macrostructures judged "good", had superior cold workability with Zr of 1 to 4 mass % in range, and were suppressed in segregation.

No. 2-8 with an Fe concentration exceeding the upper limit, No. 2-9 with a Cr concentration exceeding the upper limit, and Nos. 2-10 to 2-12 further with amounts of V, Mo, or Mo+V lower than the lower limits exhibited remarkable effects of composition segregation and were evaluated as "poor" by the segregation judgment method. Further, Nos. 2-13 to 2-15 with Cr concentrations lower than the lower limit failed to reach the targeted 920 MPa of tensile strength of the solution treated and annealed material.

Example 3

(5) of the present invention will be explained in further detail using the following examples.

Table 5 shows examples of (5) of the present invention with different concentrations of O and N. Note that the methods of production, methods of evaluation, etc. were the same as in the above-mentioned [Example 1]. All of the samples of Table 5 had H concentrations of 0.02 mass % or less.

TABLE 5

| Sample No. | Chemical compositions (mass %) Al | Fe | Cr | V | Mo | Zr | O | N | Mo + V (mass %) | Oxygen equivalent Q formula [1] | Pre-aging heat treatment solution treated and annealed material Tensile strength (MPa) | Cold drawing: Limit cold drawing reduction (%) | Drawing reduction 50% or more success | Post-drawing reduction 50% tensile strength (MPa) | Result of evaluation by segregation judgment method (others) | Remarks |
|---|---|---|---|---|---|---|---|---|---|---|---|---|---|---|---|---|
| 3-1 | 3.2 | 2.2 | 7.9 | 7.8 | — | — | 0.090 | 0.006 | — | 0.107 | 931 | >80% | Good | 1325 | Good | Comp. ex. of (5) |
| 3-2 | " | " | " | " | — | — | 0.159 | 0.007 | — | 0.178 | 984 | >80% | Good | 1378 | Good | Inv. ex. |
| 3-3 | " | " | " | " | — | — | 0.189 | 0.008 | — | 0.211 | 1089 | >80% | Good | 1416 | Good | Inv. ex. |
| 3-4 | " | " | " | " | — | — | 0.264 | 0.011 | — | 0.294 | 1195 | >80% | Good | 1550 | Good | Inv. ex. |
| 3-5 | " | " | " | " | — | — | 0.369 | 0.010 | — | 0.397 | 1260 | 69% | Good | 1611 | Good | Comp. ex. of (5) |
| 3-6 | 3.1 | 2.5 | 7.5 | — | 7.8 | — | 0.088 | 0.005 | — | 0.102 | 930 | >80% | Good | 1325 | Good | Comp. ex. of (5) |
| 3-7 | " | " | " | — | " | — | 0.154 | 0.006 | — | 0.171 | 978 | >80% | Good | 1369 | Good | Inv. ex. |
| 3-8 | " | " | " | — | " | — | 0.208 | 0.007 | — | 0.227 | 1107 | >80% | Good | 1522 | Good | Inv. ex. |
| 3-9 | " | " | " | — | " | | 0.356 | 0.009 | — | 0.381 | 1253 | 69% | Good | 1604 | Good | Comp. ex. of (5) |
| 3-10 | 3.0 | 2.1 | 8.9 | 3.0 | 4.0 | — | 0.085 | 0.011 | 7.0 | 0.115 | 940 | >80% | Good | 1341 | Good | Comp. ex. of (5) |
| 3-11 | " | " | " | " | " | — | 0.160 | 0.009 | " | 0.185 | 970 | >80% | Good | 1377 | Good | Inv. ex. |
| 3-12 | " | " | " | " | " | — | 0.225 | 0.008 | " | 0.247 | 1159 | >80% | Good | 1554 | Good | Inv. ex. |
| 3-13 | " | " | " | " | " | — | 0.360 | 0.012 | " | 0.393 | 1255 | 69% | Good | 1606 | Good | Comp. ex. of (5) |
| 3-14 | 3.2 | 2.3 | 7.9 | 7.8 | — | 2.2 | 0.091 | 0.008 | — | 0.113 | 971 | >80% | Good | 1379 | Good | Comp. ex. of (5) |
| 3-15 | " | " | " | " | — | " | 0.163 | 0.007 | — | 0.182 | 996 | >80% | Good | 1421 | Good | Inv. ex. |
| 3-16 | " | " | " | " | — | " | 0.211 | 0.009 | — | 0.236 | 1149 | >80% | Good | 1549 | Good | Inv. ex. |

TABLE 5-continued

| Sample No. | Chemical compositions (mass %) Al | Fe | Cr | V | Mo | Zr | O | N | Mo + V (mass %) | Oxygen equivalent Q formula [1] | Pre-aging heat treatment solution treated and annealed material Tensile strength (MPa) | Cold drawing Limit cold drawing reduction (%) | Drawing reduction 50% or more success | Post-drawing reduction 50% tensile strength (MPa) | Result of evaluation by segregation judgment method (others) | Remarks |
|---|---|---|---|---|---|---|---|---|---|---|---|---|---|---|---|---|
| 3-17 | " | " | " | " | — | " | 0.366 | 0.010 | — | 0.394 | 1279 | 65% | Good | 1630 | Good | Comp. ex. of (5) |
| 3-18 | 3.0 | 2.3 | 6.0 | — | 7.2 | 2.5 | 0.089 | 0.006 | — | 0.106 | 960 | >80% | Good | 1367 | Good | Comp. ex. of (5) |
| 3-19 | " | " | " | — | " | " | 0.164 | 0.007 | — | 0.183 | 1003 | >80% | Good | 1424 | Good | Inv. ex. |
| 3-20 | " | " | " | — | " | " | 0.198 | 0.008 | — | 0.220 | 1137 | >80% | Good | 1569 | Good | Inv. ex. |
| 3-21 | " | " | " | — | " | " | 0.372 | 0.008 | — | 0.394 | 1283 | 65% | Good | 1638 | Good | Comp. ex. of (5) |
| 3-22 | 3.0 | 2.3 | 6.8 | 6.4 | 2.8 | 3.4 | 0.088 | 0.006 | 9.2 | 0.105 | 966 | >80% | Good | 1372 | Good | Comp. ex. of (5) |
| 3-23 | " | " | " | " | " | " | 0.170 | 0.007 | " | 0.189 | 1013 | >80% | Good | 1438 | Good | Inv. ex. |
| 3-24 | " | " | " | " | " | " | 0.199 | 0.007 | " | 0.218 | 1129 | >80% | Good | 1558 | Good | Inv. ex. |
| 3-25 | " | " | " | " | " | " | 0.258 | 0.008 | " | 0.280 | 1203 | >80% | Good | 1590 | Good | Inv. ex. |
| 3-26 | " | " | " | " | " | " | 0.372 | 0.009 | " | 0.397 | 1286 | 65% | Good | 1642 | Good | Comp. ex. of (5) |

If comparing samples with equivalent chemical compositions other than the oxygen equivalent Q, the larger the Q, the higher the value of the tensile strength of the solution treated and annealed material exhibited. Compared with Nos. 3-1, 3-6, 3-10, 3-14, 3-18, and 3-22 of Table 6 with Q's of about 0.102 to 0.115 or smaller than 0.15, the samples with Q's of 0.15 or more clearly had high tensile strengths of the solution treated and annealed material. On the other hand, Nos. 3-5, 3-9, 3-13, 3-17, 3-21, and 3-26 of Table 5 with Q's exceeding 0.3 were free of fractures and other defects up to cross-sectional reductions of cold drawing (drawing reductions) of 50%, but the limit cold drawing reduction (cross-sectional reduction where cold drawing is possible without fractures or other defects) was 69% or 65%.

With a Q of 0.15 to 0.3 in range, the tensile strength of the solution treated and annealed material was relatively high. Even if the cold drawing reduction exceeded 80%, fractures and other defects did not occur, the limit cold drawing reduction exceeded 80%, and extremely good cold workability was given. Further, in each case, the result of the segregation judgment method was a uniform macrostructure judged "good".

Note that, Nos. 3-1, 3-6, 3-10, 3-14, 3-18, and 3-22 of Table 5 with Q's of about 0.102 to 0.115 or smaller than 0.15 had tensile strengths of the solution treated and annealed material exceeding 920 MPa. These correspond to invention examples of (1) to (4) of the present invention.

As shown in Table 5, it was learned that the tensile strength as cold drawn with a drawing reduction of 50% was about 30 to 40% higher than that of a solution treated and annealed material. In this way, a material work hardened as cold worked had a high strength before aging heat treatment and could more easily give a material with a higher strength and lower Young's modulus. This corresponds to the invention examples of (6) of the present invention. Note that in the invention examples of Tables 1 to 4 as well, the material as cold drawn after a drawing reduction of 50% had a 30 to 40% higher tensile strength compared with a solution treated and annealed material after aging heat treatment and was work hardened.

In the samples of Tables 1 to 5, samples containing, by mass %, when Al is 2 to 4%, "Fe: 2 to 4%, Cr: 6.5 to 9%, and V: 5 to 10%", "Fe: 2 to 4%, Cr: 6 to 10%, and Mo: 5 to 10%", and "Fe: 2 to 4%, Cr: 6 to 10%, Mo+V (total of Mo and V): 5 to 10%" of the preferable ranges of the present invention and samples further containing Zr: 1 to 4% were already evaluated as "good" in condition by the segregation judgment method at the point of time of an aging heat treatment of 10 hours, that is, less than 24 hours, and were small in effects of composition segregation.

Example 4

Regarding the present invention, the following examples will be used to explain in further detail the (1) of the present invention, (2) of the present invention, and (3) of the present invention from the viewpoint of more efficient hardening (strengthening) by a shorter time of aging heat treatment.

Table 6 show the chemical compositions, the success of cold drawing, the tensile strength before aging heat treatment (solution treated and annealed material), the cold drawing ability, the results of evaluation by the segregation judgment method, the amount of increase in the cross-sectional Vicker's hardness due to being further held at 550° C. for 8 hours (hereinafter referred to as the amount of age hardening at 550° C.), etc. Note that the method of production, method of evaluation, etc. were the same as the above-mentioned [Example 1]. All of the samples of Table 6 had an H concentration of 0.02 mass % or less. Further, as reference, the age hardening amounts at 550° C. of No. 8 of Table 1, No. 21 of Table 2, and No. 36 of Table 3 are shown.

Here, the above amount of age hardening at 550° C. is the "amount of increase of cross-sectional Vicker's hardness with respect to the solution treated and annealed material" in the case of holding a material solution treated and annealed at 850° C. at 550° C. for 8 hours. If raising the aging heat treatment temperature to 550° C., the diffusion rate of the atoms becomes faster and the α phase precipitates in a shorter time, but the amount of hardening ends up falling compared with the case of 500° C. If comparing the amount of hardening at 550° C. from the base solution treated and annealed material in this way, it is possible to evaluate the age hardening ability of the material. Note that for the cross-sectional Vicker's hardness, the hardnesses were randomly measured at six points in the L-cross-section at a load of 9.8N and the average value was used.

TABLE 6

| Sample | Chemical compositions (mass %) | | | | | | | | Mo + V | Oxygen equivalent Q formula | Pre-aging heat treatment solution treated and annealed material Tensile strength | Cold drawing Limit cold drawing reduction | Drawing reduction 50% or more | Post-drawing reduction 50% tensile strength | Results of evaluation by segregation judgment | Am't of aging hardening at |
|---|---|---|---|---|---|---|---|---|---|---|---|---|---|---|---|---|
| No. | Al | Fe | Cr | V | Mo | Zr | O | N | (mass %) | [1] | (MPa) | (%) | success | (MPa) | method | 550° C. |
| 40 | 3.0 | 2.1 | 6.2 | 4.1 | — | — | 0.201 | 0.004 | — | 0.212 | 984 | >80% | Good | 1378 | Good | 116 |
| 41 | 3.0 | 2.5 | 6.7 | 4.5 | — | — | 0.199 | 0.005 | — | 0.213 | 987 | >80% | Good | 1380 | Good | 95 |
| 42 | 2.9 | 3.0 | 7.2 | 5.0 | — | — | 0.201 | 0.005 | — | 0.215 | 987 | >80% | Good | 1378 | Good | 87 |
| 43 | 3.0 | 2.5 | 6.2 | 5.0 | — | — | 0.205 | 0.005 | — | 0.219 | 988 | >80% | Good | 1380 | Good | 92 |
| 44 | 3.1 | 3.6 | 7.9 | 6.0 | — | — | 0.202 | 0.006 | — | 0.219 | 990 | >80% | Good | 1388 | Good | 83 |
| 45 | 3.1 | 2.5 | 5.4 | — | 4.1 | — | 0.198 | 0.006 | — | 0.215 | 980 | >80% | Good | 1371 | Good | 117 |
| 46 | 3.1 | 3.1 | 6.2 | — | 4.5 | — | 0.201 | 0.005 | — | 0.213 | 980 | >80% | Good | 1370 | Good | 105 |
| 47 | 3.0 | 3.5 | 6.5 | — | 4.9 | — | 0.197 | 0.005 | — | 0.211 | 982 | >80% | Good | 1375 | Good | 96 |
| 48 | 2.7 | 3.6 | 6.9 | — | 5.8 | — | 0.189 | 0.004 | — | 0.200 | 987 | >80% | Good | 1380 | Good | 84 |
| 49 | 2.9 | 2.3 | 5.5 | 2.1 | 2.0 | — | 0.189 | 0.005 | 4.1 | 0.203 | 987 | >80% | Good | 1381 | Good | 114 |
| 50 | 3.0 | 2.5 | 6.9 | 2.7 | 2.4 | — | 0.199 | 0.004 | 5.1 | 0.210 | 990 | >80% | Good | 1385 | Good | 99 |
| 51 | 3.0 | 3.1 | 6.1 | 3.0 | 2.5 | — | 0.198 | 0.004 | 5.5 | 0.209 | 990 | >80% | Good | 1384 | Good | 99 |
| 52 | 2.9 | 3.0 | 6.4 | 3.4 | 2.4 | — | 0.197 | 0.005 | 5.8 | 0.211 | 996 | >80% | Good | 1393 | Good | 91 |
| 53 | 3.1 | 3.7 | 7.5 | 3.1 | 2.6 | — | 0.202 | 0.004 | 5.7 | 0.213 | 997 | >80% | Good | 1395 | Good | 83 |
| Table 1 No. 8 | 3.0 | 2.5 | 7.9 | 9.4 | — | — | 0.149 | 0.007 | — | 0.168 | 966 | | | | | 66 |
| Table 2 No. 21 | 3.2 | 3.9 | 7.4 | — | 6.1 | — | 0.148 | 0.008 | — | 0.170 | 959 | | | | | 68 |
| Table 3 No. 36 | 2.8 | 2.4 | 7.5 | 4.2 | 4.9 | — | 0.158 | 0.005 | 9.1 | 0.172 | 979 | | | | | 66 |

Sample Nos. 40 to 53 of Table 6 are invention examples. Sample Nos. 40 to 44 had ranges, by mass %, of Al: 2 to 4%, Fe: 2 to 4%, Cr: 6.2 to 8%, and V: 4 to 6%, Sample Nos. 45 to 48 had ranges, by mass %, of Al: 2 to 4%, Fe: 2 to 4%, Cr: 5 to 7%, and Mo: 4 to 6%, and Sample Nos. 49 to 53 had ranges, by mass %, of Al: 2 to 4%, Fe: 2 to 4%, Cr: 5.5 to 7.5%, and Mo+V (total of Mo and V): 4 to 6%. These all had age hardening amounts at 550° C. of 83 to 117 or more than 80. The cross-sectional Vicker's hardness of the solution treated and annealed material was about 320, so the hardness increase rates are about 25 to 35%. As opposed to this, No. 8 of Table 1, No. 21 of Table 2, and No. 36 of Table 3 with β-stabilizing elements Fe, Cr, V, and Mo greater than the above ranges, shown as reference, all had age hardening amounts at 550° C. of less than 70 and hardness increase rates of about 20%. In this way, when in the range, by mass %, of "Al: 2 to 4%, Fe: 2 to 4%, Cr: 6.2 to 8%, V: 4 to 6%", "Al: 2 to 4%, Fe: 2 to 4%, Cr: 5 to 7%, Mo: 4 to 6%", or "Al: 2 to 4%, Fe: 2 to 4%, Cr: 5.5 to 7.5%, Mo+V (total of Mo and V): 4 to 6%", it is learned that efficient hardening (strengthening) is possible by a shorter time of aging heat treatment.

Note that, as shown in Table 6, Sample Nos. 40 to 53 had a tensile strength of the solution treated and annealed material of 980 MPa or more, a limit cold drawing reduction of over 80%, and good cold workability. Further, the tensile strength as cold drawn at a drawing reduction of 50% was about 40% higher than the solution treated and annealed material. As explained above in [Example 3], a work hardened material as cold worked had a high strength before aging heat treatment and more easily gave a material with a higher strength and lower Young's modulus.

In the above examples, bar-shaped materials were described in detail, but the above effects of the present invention similar to the bars can be obtained even with materials hot rolled into plate shapes of about 10 mm thickness from hot forged intermediate materials.

INDUSTRIAL APPLICABILITY

According to the present invention, it is possible to provide a β-type titanium alloy keeping the content of the relatively expensive β-stabilizing elements such as V or Mo down to a total of 10 mass % or less and reducing the effects of composition segregation of Fe and Cr and thereby able to keep the Young's modulus and density relatively low. Due to this, it is possible to obtain a stable material by a relatively low material cost in various applications such as springs, golf club heads, and fasteners and possible to produce products having properties of low Young's modulus and high specific strength.

The invention claimed is:

1. A β-type titanium alloy comprising, by mass %, Al: 2 to 5%, Fe: 2 to 4%, Cr: 5 to 9%, and Mo: 4 to 10% in ranges and having a balance of Ti and unavoidable impurities, and which will have the following properties after solution treatment, drawing, and aging:

a difference between a maximum value and a minimum value thereof is in a range of 10 to 20 after solution treatment and aging when Vicker's hardness is randomly measured at six points in each of three L-cross-sections, an α phase and a β phase, and the α phase is substantially uniformly precipitated, wherein the aging is performed by heat treatment for 24 hours or less and wherein the drawing is conducted to a cross-sectional reduction of 50% or more.

2. The β-type titanium alloy as set forth in claim 1, characterized in that an oxygen equivalent Q of formula [1] is 0.15 to 0.30:

$$\text{Oxygen equivalent } Q=[O]+2.77[N] \qquad \text{formula [1]}$$

where, [O] is O (oxygen) content (mass %) and [N] is N content (mass %).

3. A worked product obtained by work hardening the β-type titanium alloy as set forth in claim 1.

4. The β-type titanium alloy as set forth in claim 1, wherein the β-type titanium alloy does not contain Sn.

* * * * *